United States Patent [19]

Ward

[11] 4,183,503

[45] Jan. 15, 1980

[54] DEMOLITION TOOL

[76] Inventor: Leslie J. Ward, 2450 Blackwood Dr., Vineland, N.J. 08360

[21] Appl. No.: 962,881

[22] Filed: Nov. 22, 1978

[51] Int. Cl.[2] ..... B66F 3/00

[52] U.S. Cl. ..... 254/131

[58] Field of Search ..... 254/18, 21, 25, 44, 254/17, 120, 129, 130, 131, 131.5, 132

[56] References Cited

U.S. PATENT DOCUMENTS

| | | | |
|---|---|---|---|
| D. 199,019 | 8/1964 | Marson | D93/4 |
| 1,389,820 | 9/1921 | Downey | 254/131 |
| 1,455,019 | 5/1923 | Cameron | 254/131 |
| 1,570,192 | 1/1926 | Younick | 254/131 |
| 2,195,667 | 4/1940 | Baker | 254/131 |
| 2,502,271 | 3/1950 | Parker | 254/131 |
| 3,041,042 | 6/1962 | Sanders | 254/130 |
| 3,744,758 | 7/1973 | Nakasone | 254/129 |
| 3,754,732 | 8/1973 | Olson | 254/131 |

*Primary Examiner*—Robert C. Watson

*Attorney, Agent, or Firm*—Leonard L. Kalish

[57] ABSTRACT

A one-piece demolition-tool including an elongated stem terminating in two differently shaped prying-members at opposite ends thereof, and a dual-function pivot-and-handle bar near each end of said stem, disposed crosswise thereof, each pivot-and-handle bar being in operative juxtaposition to both prying-members and being arranged to serve as an off-center pivot in relation to the prying-member nearest to it when that prying-member is prying and to serve as a twist-resisting force-applying handle in relation to the prying-member farthest from it when that prying-member is prying, and each pivot-and-handle bar having two opposite handle-portions extending laterally and oppositely from the stem, and each handle-portion being of sufficient length to enable the user of the demolition-tool to engage the two handle-portions with a major portion of the width of his hands when closed around the handle-portions so as to enable the user effectively to apply his needed manual force for the operation of the tool.

8 Claims, 5 Drawing Figures

FIG. 1
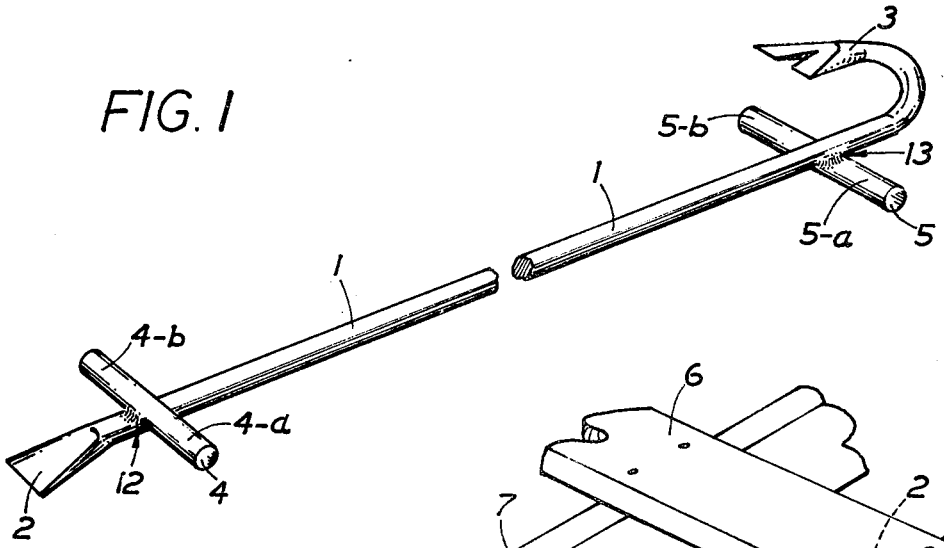
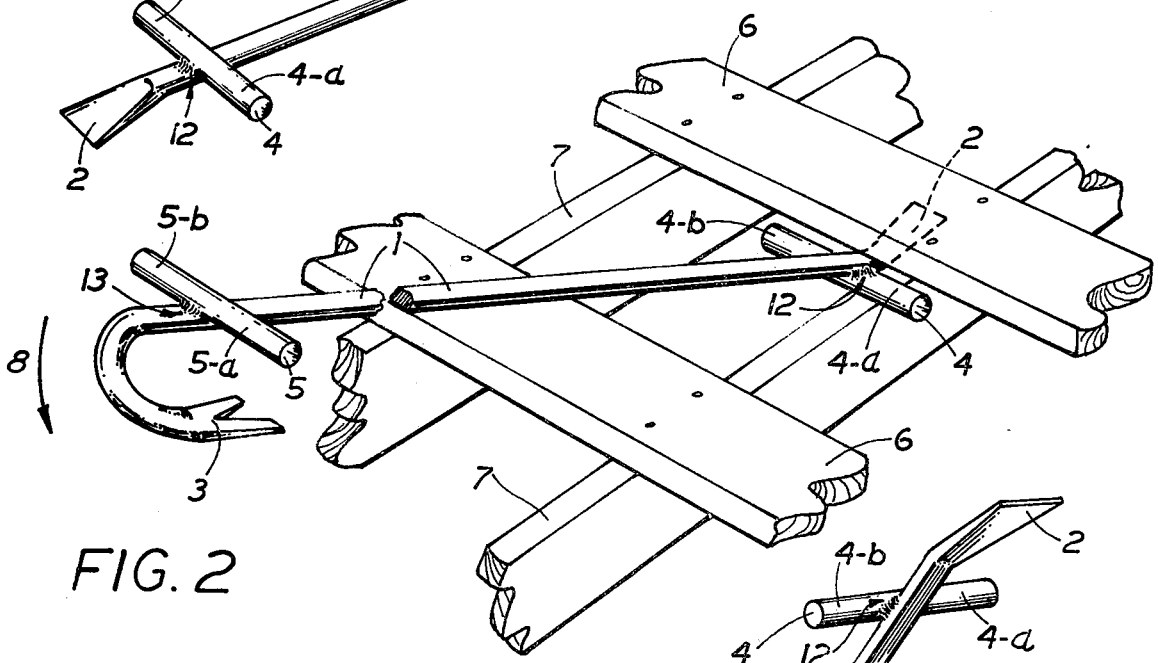
FIG. 2
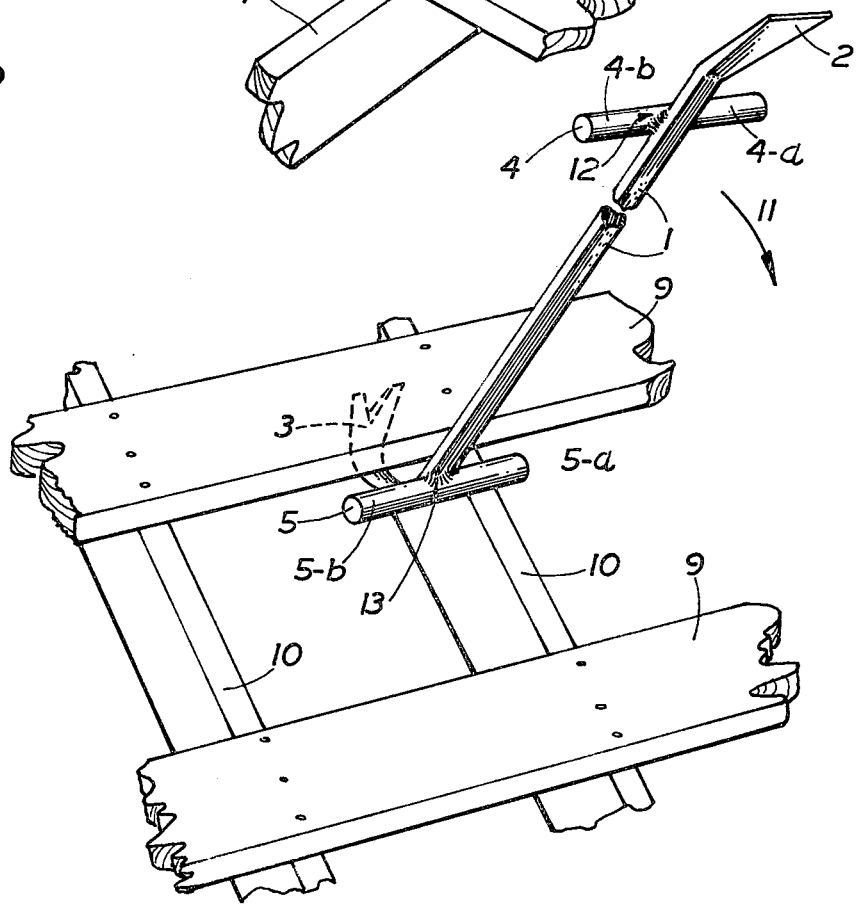
FIG. 3

DEMOLITION TOOL

BRIEF SUMMARY OF THE INVENTION

The object of the present invention is a versatile one-piece demolition-tool of simple, inexpensive and effective construction for prying floor-boards from floor-joists to which they are nailed and for prying wall-boards or wall-sheathing strips from wall-studs to which they are nailed and for prying wooden roofers from roofing-joists to which they are nailed. A further object of the present invention is to facilitate and to reduce the labor and time required for such demolition operations and to increase the efficiency of the demolition-tool, and to minimize the damage to the pried-apart pieces, thereby to preserve their utility for re-use.

Accordingly, the demolition-tool of the present invention comprises a conventional demolition bar or wrecking bar having a flattened and widened chisel-like prying-member at one one thereof generally in line with the main body or stem thereof but bent out of the axis of the stem at a small angle, and having at the other end thereof a flattened and widened bifurcated chisel-like prying-member bent back upon the main body or stem of the tool, and to each of the opposite ends of which stem a crosswise-disposed dual-function pivot-and-handle bar is welded so as, in effect, to become integral therewith and constitute therewith the one-piece demolition tool of the present invention. Each pivot-and-handle bar serves as a pivot-member when the prying member adjacent to it is in the prying position while the other pivot-and-handle bar at the other end of the tool serves as a twist-resisting force-applying handle, and vice versa.

U.S. Pat. Nos. 1,389,820, 1,455,019, 1,570,192, 2,195,667, 2,502,271, 3,041,042, Des. 199,019 and 3,754,732 are believed to represent the state of the art.

BRIEF DESCRIPTION OF THE DRAWINGS

FIG. 1 represents a perspective view of the demolition-tool of the present invention.

FIG. 2 represents a perspective view of the demolition-tool of the present invention with its in-line prying-member disposed in prying relation to a floor-board or floor-plank nailed to floor-joists.

FIG. 3 represents a perspective view of the demolition-tool of the present invention with its inwardly facing prying-member in prying relation to a wooden wall-plank or wall-sheathing strip nailed to wall-studs or in relation to wooden roofers nailed to roof-joists.

DETAILED DESCRIPTION OF THE INVENTION

Figure 5:
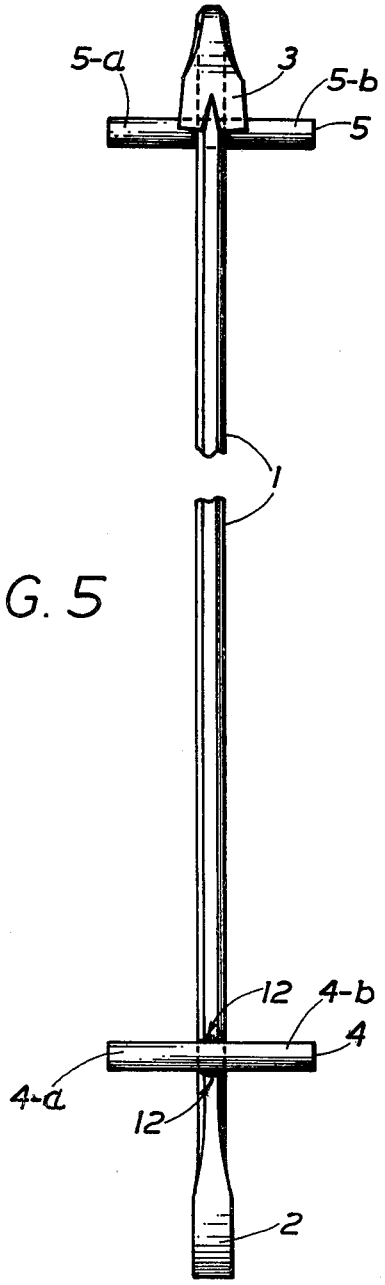
FIG. 5 represents a top plan view of the demolition-tool of the present invention viewed in direction of line 5—5 on FIG. 4.
Figure 4:
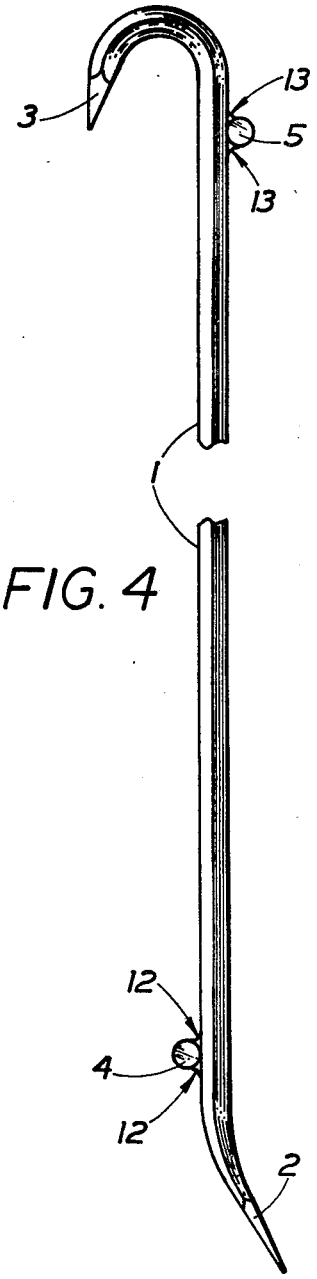
FIG. 4 represents a side view of the demolition-tool of the present invention.

The demolition-tool of the present invention, shown in FIGS. 1, 4 & 5, comprises a conventional wrecking-bar, or iron or steel, having an elongated stem 1 and having two differently-shaped and differently oriented prying-members 2 & 3 at the opposite ends thereof, said demolition-tool having two novel dual-function pivot-and-handle bars 4 & 5 welded to the stem 1 thereof, as shown in FIGS. 1, 4 and 5.

Each of the pivot-and-handle bars 4 and 5 is at a right-angle to the stem 1 of the demolition-tool and is preferably disposed on the side of the stem 1 opposite to the direction in which the prying member at the same end of the stem turns or inclines away from the axis of the stem, and the axis of each pivot-and-handle bar lies in a plane spaced from a parallel plane in which the axis of the stem lies, as shown in FIG. 4, such disposition of the pivot-and-handle bars providing a more effective pivotation and enhancing the leverage so as to require a lesser force on the part of the operator.

The flattened and widened chisel-like prying-member 2, at one end of the stem 1 of the demolition-tool, is generally in line with the stem 1 as indicated in FIG. 5, though bent out of line therefrom at a small angle as indicated in FIG. 4. The other prying-member 3 is flattened and widened and bifurcated, and turned back upon the stem 1, as shown in FIGS. 1, 4 and 5.

FIG. 2 illustrates the use of the demolition-tool of the present invention in which the in-line chisel-like prying-member 2 thereof pryingly engages the floor board, plank or sheathing 6 nailed to the floor joists or roof joists 7, which are pried and so removed from the joists by pressing the opposite end of the demolition-tool in the direction of the arrow 8 with the two hands of the operator firmly closed on the two handle-portions 5-*a* and 5-*b* of the dual-function pivot-and-handle bar 5, while the handle-portion 4-*a* of the other pivot-and-handle-bar 4 pivotally bears against the joist 7 in off-center relation to the stem 1 and the prying member 2 as shown in FIG. 2.

FIG. 3 illustrates an alternative use of the demolition-tool of the present invention, in which the prying-member 3 thereof pryingly engaging a board or sheathing 9 nailed to the wall-studs or joists 10, with the portion 5-*a* of the dual-function pivot-and-handle bar 5 pivotally bearing against the stud or joist 10 in off-center relation to the stem 1 and the prying member 3. With his two hands closed on the two portions 4-*a* and 4-*b* of the pivot-and-handle bar 4, the operator swings the demolition-tool in the direction of the arrow 11, thereby prying the board 9 from the stud or joists 10.

The spacing between the floor or roofing joists as well as the spacing between wall-studs is generally 16 inches. Therefore the pivot-and-handle bar (4 or 5) which functions as the pivot can not have both of its pivot-portions a and b bearing on a joist or stud unless the pivot-and-handle bars were of a length which would make the demolition-tool cumbersome and unwieldly, and even such length would not ensure that both portions a and b thereof would bear on two joists or studs, unless time-consuming care were taken to center the stem 1 equidistantly between the two joists or studs.

However, it is easy to merely position the prying-member (2 or 3) adjacent a joist or stud, with only one of the pivot portions (a or b) of the pivot-and-handle bar (4 or 5) pivotally bearing against the adjacent joist or stud. However, with such off-center pivotal bearing, the demolition-tool will lean or twist in the direction of the opposite unsupported pivot portion of the pivot-and-handle bar nearest the prying member (2 or 3) which is in the prying position, when the prying force is applied to the opposite end of the demolition-tool. Such tilting or twisting of the demolition-tool diminishes or may totally nullify the effect of the prying force applied to the other end of the tool, unless the operator can apply a twist-resisting force to the opposite end of the tool simultaneously with his application of the prying force thereto. The construction of the demolition-tool of the present invention provides means whereby the operator can easily and effectively apply an adequate anti-twisting force to the opposite free end of the stem 1 of the demolition-tool simultaneously with his application of the prying force thereto, by griping both handle-portions (a and b) of the handle-and-pivot bar at the free end of the tool with his two hands and by applying the prying force to the two handle-portions a and b thereof with just a sufficient differential so as to prevent the prying end of the demolition tool from leaning or twisting towards the unsupported pivot portion of the pivot-and-handle bar providing the pivotation, without diminishing the prying force applied to the demolition-tool as a whole.

In the customary use of conventional wrecking-bars, the chisel-like end of one of the two prying members thereof must be forced between the floor or roof joist or wall-stud, on the one hand, and the floor board or roofer or wall-sheathing-board, on the other hand, each time another board, roofer or sheathing board is reached for removal. This is done by repeatedly ramming the prying member of the wrecking-bar between the joist or stud and the board or roofer nailed thereto, until the prying member has sufficiently penetrated therebetween to enable the operator to pry the board or roofer from the joist or stud. Such repeated ramming action needed for each successive floor-board, roofer or sheathing board not only consumes more time and requires the expenditure of energy than is necessary with the demolition-tool of the present invention, but also damages the board being so removed as well as the joist or stud to which it is nailed, so as to impair their subsequent re-use or salvage value in cases where it is desired to re-sue the dismantled boards and joist and studs. In using the demolition-tool of the present invention only the first floor board or roofer or wall-sheathing board need be removed in the customary manner of using a conventional wrecking bar. After the first floor board or roofer or wall-sheathing board has been so removed, all the other, successive, boards can be removed, one after the other, without any of the aforementioned ramming operation, by merely pivoting one of the pivotal portions of the pivot-and-handle bar on the joist or stud, with the nearest prying member poised beneath or in back of a board, roofer or wall-sheating-strip, and simultaneously applying the prying force and anti-twisting force to the opposite free end of the demolition tool with the hands of the operator firmly griping the two handle portions of the pivot-and-handle bar at the free end of the demolition-tool.

Although the two pivot-and-handle bars 4 and 5 are shown in the drawings as being welded to the stem 1 by weld-fillets 12 & 13, such pivot-and-handle bars can be united with the stem 1 by being fused to each other by pressing them together while the juxtaposed portions thereof are at a fusing or forging temperature.

FIGS. 2 and 3 are intended to represent the median plane of the demolition-tool, common to its stem 1 and its two prying members 2 and 3, as being generally parallel to the plane of the joists or stud which is at a right angle to the boards 7 and 9.

The demolition-tool of the present invention saves time and energy in removing floor boards, roofers and other boards from joists and studs, and thus reduces the cost of such operation and also helps to preserve the dismantled members for re-use. Furthermore, the one-piece construction of the demolition-tool of the present invention reduces the cost and enhances the durability thereof, simplifies its use and avoids the hazard of misplacing or loosing separable components and the task of disassembly, reassembly and adjustment of separable components.

Having shown and described an embodiment of my invention, I claim the following:

1. A demolition-tool including an elongated stem having a prying member at each of the opposite ends thereof, and including a pivot-and-handle bar at each end of said stem in operative juxtaposition to the prying members, said pivot-and-handle bars being disposed crosswise of the stem, with the two opposite portions thereof arranged and extending from the stem in opposite directions to a distance sufficient for either opposite portion thereof so as to serve as an off-center pivot when the prying member adjacent thereto is in its prying position and arrange for the opposite portions thereof to serve as a pair of force-applying and anti-tilt handles when the prying member at the far end of the stem is in its prying position, and each of said pivot-and-handle bars being affixed to the stem.

2. A demolition-tool including an elongated stem having two differently oriented prying members at the opposite ends thereof, and including a pivot-and-handle bar at each end of said stem in operative juxtaposition to both prying members, said pivot-and-handle bars being fixedly disposed crosswise of the stem, with the two opposite portions thereof arranged and extending from the stem in opposite directions to a distance sufficient for either opposite portion thereof so as to serve as an off-center pivot when the prying member adjacent thereto is in its prying position and arranged for the opposite portions thereof to serve as a pair of force-applying and anti-tilt handles when the prying member at the far end of the stem is in its prying position.

3. A one-piece demolition-tool including an elongated stem having two differently shaped and differently oriented prying members at the opposite ends thereof, and including a pivot-and-handle bar at each end of said stem in operative juxtaposition to both prying members, said pivot-and-handle bar being fixedly disposed crosswise of the stem, with the two opposite portions thereof arranged and extending from the stem in opposite directions to a distance sufficient for either opposite portion thereof so as to serve as an off-center pivot when the prying member adjacent thereto is in its prying position and arranged for the opposite portions thereof to serve as a pair of force-applying and anti-tilt handles when the prying member at the far end of the stem is in its prying position.

4. A one-piece demolition-tool including an elongated stem terminating in two differently shaped prying-members at opposite ends thereof, and a dual-function pivot-and-handle bar near each end of said stem disposed crosswise thereof, each pivot-and-handle bar being in operative juxtaposition to both prying-members and being arranged to serve as an off-center pivot in relation to the prying-member nearest to it when that prying-member is in its prying position and to serve as a twist-resisting force-applying handle in relation to the prying-member farthest from it when that prying-member is in its prying position, and each pivot-and-handle bar having two opposite handle-portions extending laterally and oppositely from the stem and being of sufficient length to for the user of the demolition tool to engage the two handle-portions of the pivot-and-handle bar at the end of the stem opposite from the prying member poised for prying, sufficiently to enable the user simultaneously to exert an adequate prying force and an adequate anti-tilt force on the demolition tool for the effective operation of the tool.

5. A demolition tool according to any one of claims 1, 2, 3 or 4, in which the axis of each pivot-and-handle-bar lies in a plane spaced from a parallel plane in which the axis of the stem lies.

6. A demolition tool according to any one of claims 1, 2, 3 or 4 in which the pivot-and-handle-bars are welded to the stem.

7. A demolition tool according to any one of claims 1, 2, 3 or 4, in which the pivot-and-handle-bars are disposed on opposite sides of the stem.

8. A demolition tool according to any one of claims 1, 2, 3 or 4 in which each of the two pivot-and-handle-bars is disposed on the side of the stem opposite to the direction in which the prying member at the same end of the stem inclines away from the stem.

* * * * *